United States Patent [19]

Brookhart

[11] Patent Number: 4,669,635

[45] Date of Patent: Jun. 2, 1987

[54] TOOL FOR CLOSING AND CLEARING THE TIP OF CAULKING TUBE

[76] Inventor: David E. Brookhart, R.D. #1, Box 485, Liverpool, Pa. 17045

[21] Appl. No.: 790,889

[22] Filed: Oct. 24, 1985

[51] Int. Cl.[4] ..... B67D 1/08

[52] U.S. Cl. ..... 222/151; 222/563; 81/3.49; 15/104 R

[58] Field of Search ..... 222/563, 149, 151, 326, 222/327; 239/114, 123; 137/242, 244, 245.5; 15/104 R, 104.05, 104.165; 81/3.34, 3.45, 3.48, 3.49

[56] References Cited

U.S. PATENT DOCUMENTS

| | | | |
|---|---|---|---|
| 1,256,478 | 2/1918 | Hansen | 15/104.165 |
| 1,296,545 | 3/1919 | Maloney | 81/3.49 |
| 1,991,523 | 2/1935 | Robinson | 222/151 |
| 3,406,875 | 10/1968 | Park | 222/151 |
| 3,481,510 | 12/1969 | Allen | 222/327 |
| 3,578,224 | 5/1971 | Greenhut | 222/563 |
| 4,213,546 | 7/1980 | Massey | 222/326 |

FOREIGN PATENT DOCUMENTS

| | | | |
|---|---|---|---|
| 238090 | 5/1964 | Austria | 222/563 |
| 219609 | 7/1924 | United Kingdom | 81/3.49 |

*Primary Examiner*—H. Grant Skaggs
*Attorney, Agent, or Firm*—Thomas Hooker

[57] ABSTRACT

A tool for closing and clearing the tip of a caulking tube includes a shaft, barbs on the shaft and a blade guide and hardened caulk cutting groove extending along the shaft.

5 Claims, 3 Drawing Figures

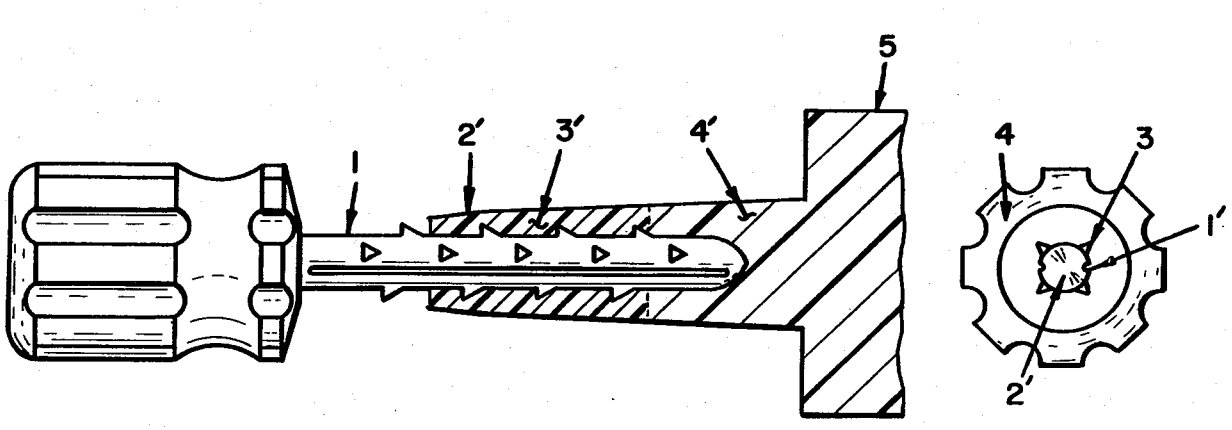
FIG. 1
FIG. 3
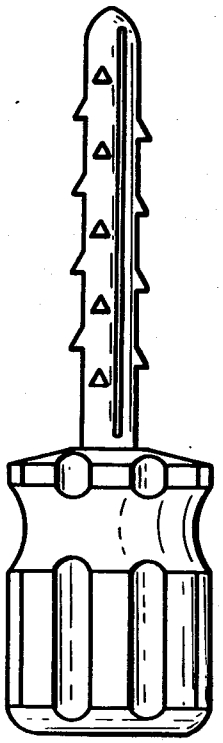
FIG. 2

TOOL FOR CLOSING AND CLEARING THE TIP OF CAULKING TUBE

The invention relates to the caulking art and more particularly to a tool used to seal the tip of a partially used caulking tube so that the remainder of the caulking material in the tube may be used at a later date. Prior to use of the remainder of the material, the tool is withdrawn from the tip carrying with it the surrounding hardened caulking material. The hardened caulking material may be removed from the tool to permit reuse of the tool.

It is known to close the end of a partially used tube of caulking by inserting a nail in the tube tip. The caulking in the tip hardens around the nail. The nail does not engage the surrounding hardened material so that when it is removed from the tip the hardened material is left in the tip. It is difficult to dig out the hardened material from the tip to permit flowing of the remaining soft caulking material in the tube through the tip. Sometimes a partially used caulking tube containing considerable usable caulking material is discarded because of the inability to clear the hardened caulking material from the tip.

Other objects and features of the invention will become apparent as the description proceeds, especially when taken in conjunction with the accompanying drawings illustrating the invention, of which there is one sheet and one embodiment.

IN THE DRAWINGS

FIG. 1 is a side view of a tool according to the invention with the shaft inserted in a tip of a caulking tube shown in section;

FIG. 2 is a side view of the tool of FIG. 1; and

FIG. 3 is an end view illustrating the shaft and handle of the tool.

The tool shown in the drawings includes an elongate straight shaft 1 having a handle 4 at one end thereof and a rounded insertion tip 2 at the other end thereof. A plurality of spaced barbs 3 project from the surface of the shaft. The barbs are spaced around the circumference of the shaft and along the length of the shaft between the handle 4 and the end 2. A pair of circumferentially opposed grooves 1' extend longitudinally along the shaft past the barbs. The grooves having a bottom wall and side walls extending substantially from the handle 4 to the tip 2. As illustrated, the barbs each include a surface facing toward the handle.

The tool is used following caulking to close the end of a partially emptied caulking tube. Tubes of this type include a tubular body filled with flowable caulking material and a smaller diameter flow tip through which the caulking material is forced for application in a desired manner. The caulking tube contains a relatively large volume of caulking which may not be fully exhausted by a given application. The caulking material in the tip of a partially exhausted tube hardens or solidifies thereby clogging the tip and rendering it difficult and in some cases impossible to clear the tip to permit use of the remaining flowable caulking material in the tube.

The disclosed tool is used to seal the tip of a partially used caulking tube as shown in FIG. 1. The shaft 1 is inserted into tip 2' of partially emptied caulking tube 5 so that a number or all of the barbs 3 are surrounded by the flowaale caulking in the tip. With the passage of time this caulking hardens or cures to form a hard non-flowable portion 3' in the tip 2'. The remaining material 4' in the tip and tube remains flowable and available for use upon clearing of the tip.

The hardened caulking material 3' is removed from the tip by grasping the tool handle and pulling the handle outwardly of the tube. Outward movement of the tool pulls the barbs and the caulk-engaging surfaces on the barbs against the hardened caulking material 3' thereby withdrawing the material from the tip with the tool.

Upon withdrawal of the hardened material and tool the remaining flowable caulking material 4' may be flowed from the tube and applied as desired.

The hardened caulking material 3', surrounds and tightly engages the shaft and barbs. This material is easily removed from the tool by positioning the tip of a cutting blade in the end of each groove 1' adjacent the handle and then sliding the blade along the toward the insertion tip 2 thereby longitudinally slicing the hardened material. The two slices formed by moving the blade along the opposed grooves 1' sever the hardened material into two semi-circular portions which are easily disengaged from the shaft and barbs. The tool is now cleaned and available for use in closing a tube as previously described.

A tool may be used to close and clear tips of caulking tubes and tubes of sealant of various types, including the commonly used throw-away cartridges of putty, silicone rubber and other types of sealant. These cartridges are used with hand operated plunger guns. The tool may also be used to close the tip or mouths of other types of tubes such as fillable putty guns, hand collapsible tubes having flexible walls and the like.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A tool for closing and clearing the tip of a caulking tube or the like comprising a shaft, a handle on one end of the shaft, a plurality of spaced hardened caulk-engaging barbs on the shaft and a first blade guide and hardened caulk-cutting groove having a bottom wall and side wall extending along the length of the shaft past the barbs in a direction from the handle to the other end thereof.

2. A tool as in claim 1 wherein the barbs include hardened caulk-engaging surfaces facing toward the handle.

3. A tool as in claim 2 wherein the groove extends longitudinally along the shaft.

4. A tool as in claim 3 including a second groove like the first groove, the first and second grooves being located on opposite sides of the shaft.

5. A tool as in claim 4 wherein the barbs are spaced along and around the surface of the shaft.

* * * * *